US008172634B2

(12) United States Patent
Nishijima et al.

(10) Patent No.: US 8,172,634 B2
(45) Date of Patent: May 8, 2012

(54) MANUFACTURING METHOD OF FIELD EMISSION CATHODE

(75) Inventors: Mitsutaka Nishijima, Saitama (JP); Kenichi Toya, Saitama (JP); Takashi Iwasa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/958,491

(22) Filed: Dec. 2, 2010

(65) Prior Publication Data

US 2011/0143626 A1 Jun. 16, 2011

(30) Foreign Application Priority Data

Dec. 15, 2009 (JP) ..... 2009-283809

(51) Int. Cl.
*H01J 9/04* (2006.01)

(52) U.S. Cl. ..... 445/50; 445/51; 313/310

(58) Field of Classification Search ..... 313/309–311, 313/495–497; 445/49–51
See application file for complete search history.

(56) References Cited

U.S. PATENT DOCUMENTS

| | | | | |
|---|---|---|---|---|
| 6,492,769 | B1 * | 12/2002 | Oda et al. | 313/495 |
| 6,827,619 | B2 * | 12/2004 | Oda et al. | 445/6 |
| 6,910,936 | B2 * | 6/2005 | Shimazu et al. | 445/24 |
| 7,335,081 | B2 * | 2/2008 | Iwaki et al. | 445/6 |
| 2003/0020395 | A1 * | 1/2003 | Oda et al. | 313/495 |
| 2003/0162467 | A1 * | 8/2003 | Shimazu et al. | 445/50 |

FOREIGN PATENT DOCUMENTS

JP 07-014504 A 1/1995

* cited by examiner

*Primary Examiner* — Bumsuk Won

(74) *Attorney, Agent, or Firm* — Capitol City TechLaw, PLLC

(57) ABSTRACT

To provide a manufacturing method of a field emission cathode, which method exerts no adverse effect on element characteristics at the time when etching is performed with an ion beam. A sacrificial layer 4 made of a thermosetting resin is formed on a gate electrode layer 3. An opening section 5 is formed in the sacrificial layer 4 and the gate electrode layer 3 by irradiating a focused ion beam, and a hole section 6 is formed by etching the insulating layer 2 by using the sacrificial layer 4 and the gate electrode layer 3 as a mask. An emitter electrode 8 is formed in the hole section 6, and the emitter material 7 on the sacrificial layer 4 is removed together with the sacrificial layer 4 on the gate electrode layer 3.

9 Claims, 3 Drawing Sheets

MANUFACTURING METHOD OF FIELD EMISSION CATHODE

This application claims the foreign priority benefit under 35 U.S.C. §119 of Japanese Patent Application No. 2009-283809 filed on Dec. 15, 2009, the disclosure of which is incorporated herein by reference.

BACKGROUND OF THE INVENTION

1. Field of the Invention

The present invention relates to a manufacturing method of a field emission cathode.

2. Description of the Related Art

The field emission cathode used as an electron-emitting element is roughly classified into the hot cathode type and the cold cathode type. Among these, the hot cathode type is used in the field represented by a vacuum tube. However, the integration of the hot cathode type is difficult because it needs to be heated. On the other hand, the cold cathode type, which needs not be heated, can be formed into a fine structure, and hence is expected to be applied to a flat panel display, a voltage amplifying element, a high-frequency amplifying element, and the like.

As the cold field emission cathode, for example, a field emission cathode experimentally manufactured on a silicon wafer by C. A. Spindt is known. The cold field emission cathode can be manufactured, for example, by a method shown in FIG. 2.

In the manufacturing method, as shown in FIG. 2(*a*), an insulating layer 12 made of a thermally oxidized film is first formed on an Si substrate 11, and then a gate electrode layer 13 made of Nb is formed on the insulating layer 12.

Next, as shown in FIG. 2(*b*), a resist 14 is applied on the gate electrode layer 13 and is developed after being exposed via a mask (not shown), so that an opening section 15 having a predetermined pattern is formed.

Next, as shown in FIG. 2(*c*), a gate hole 16 is formed in the gate electrode layer 13 by reactive ion etching (RIE) using $SF_6$, or the like. Further, the insulating layer 12 is subsequently etched by buffer hydrofluoric acid (BHF), so that a hole 17 reaching the Si substrate 11 is formed.

Next, as shown in FIG. 2(*d*), a sacrificial layer 18 made of Al is formed on the gate electrode layer 13 by oblique vapor deposition. In the oblique vapor deposition which is used to avoid deposition of Al on the Si substrate 11 in the hole 17, Al is vapor-deposited at a shallow incident angle almost in parallel to the Si substrate 11 toward the central axis X of the gate hole 16 and the hole 17 which are formed perpendicularly to the Si substrate 11.

Next, as shown in FIG. 2(*e*), an emitter material 19 made of Mo is vapor-deposited from vertically above the Si substrate 11, so that a cone-shaped emitter electrode 20 is formed on the Si substrate 11 in the hole 17. Then, as shown in FIG. 2(*f*), the field emission cathode is completed by removing the emitter material 19 together with the sacrificial layer 18 on the gate electrode layer 13. Note that at this time, if Al is vapor-deposited on the Si substrate 11 in the hole 17, the emitter electrode 20 is also removed simultaneously with the emitter material 19 and the sacrificial layer 18.

The field emission cathode shown in FIG. 2(*f*) comprises the Si substrate 11, the insulating layer 12 provided on the Si substrate 11, the emitter electrode 20 provided on the Si substrate 11 in the hole 17 provided in the insulating layer 12, and the gate electrode layer 13 provided on the insulating layer 12. Further, the gate electrode layer 13 comprises the gate hole 16 corresponding to the hole 17.

Meanwhile, in the manufacturing method shown in FIG. 2, as described above, the sacrificial layer 18 made of Al needs to be formed by the oblique vapor deposition in order to avoid that the emitter electrode 20 is removed simultaneously with the emitter material 19 and the sacrificial layer 18. However, the oblique vapor deposition has a problem that the control of film quality is difficult.

Further, the manufacturing method shown in FIG. 2 has a problem that a fluorine compound, which is derived from $SF_6$ used for the etching of the gate electrode layer 13 and which is derived from buffer hydrofluoric acid used for the etching of the insulating layer 12, is attached to the hole 17 so as to become a gas adsorption contaminant for the emitter electrode 20. When the gas adsorption contaminant is attached to the hole, the life of the field emission cathode is shortened.

In order to solve the problems of the manufacturing method shown in FIG. 2, a manufacturing method shown in FIG. 3 is proposed (see Japanese Patent Laid-Open No. 7-14504).

In the manufacturing method shown in FIG. 3, an insulating layer 22 made of $SiO_2$, a gate electrode layer 23 made of Nb, and a sacrificial layer 24 made of Al are first formed on an Si substrate 21 in this order as shown in FIG. 3(*a*).

Next, as shown in FIG. 3(*b*), a resist layer 25 is applied on the sacrificial layer 24 and is developed after being exposed via a mask (not shown). Thereby, an opening section 26 having a predetermined pattern is formed.

Next, as shown in FIG. 3(*c*), etching using a gas cluster ion beam B is performed by using, as a mask, the resist layer 25 with the opening section 26 formed therein, until the surface of the Si substrate 21 is exposed. Thereby, a hole 27 of the insulating layer 22 and a gate hole 28 of the gate electrode layer 23 are formed so that the gate hole 28 corresponds to the hole 27. At this time, it is possible to prevent the over-etching when the resist layer 25 is made to remain on a peel layer 4 after completion of the etching.

Next, after the remaining resist layer 25 is removed, an emitter material 29 made of Mo is vapor-deposited from vertically above the Si substrate 21 as shown in FIG. 3(*d*). Thereby, a cone-shaped emitter electrode 30 is formed on the Si substrate 21 in the hole 27.

Then, as shown in FIG. 3(*e*), a field emission cathode is completed by removing the emitter material 29 together with the sacrificial layer 24 on the gate electrode layer 23.

The field emission cathode shown in FIG. 3(*e*) comprises the Si substrate 21, the insulating layer 22 provided on the Si substrate 21, the emitter electrode 30 provided on the Si substrate 21 in the hole 27 provided in the insulating layer 22, and the gate electrode layer 23 provided on the insulating layer 22. Further, the gate electrode layer 23 comprises the gate hole 26 corresponding to the hole 27.

According to the manufacturing method shown in FIG. 3, it is not necessary to form the sacrificial layer 24 by the oblique vapor deposition. Further, the etching of the insulating layer 22 and the gate electrode layer 23 is performed by using the gas cluster ion beam. Thus, the attachment of the fluorine compound to the hole 27 is prevented, and hence the shortening of the life of the field emission cathode due to the gas adsorption contaminant can be prevented.

SUMMARY OF THE INVENTION

However, the manufacturing method shown in FIG. 3 has a problem that Al forming the gate electrode layer 23 is melted by the gas cluster ion beam B and is attached to the insulating layer 22 so as to exert an adverse effect on element characteristics, such as an effect of increasing the gate current.

Thus, an object of the present invention is to solve the above described problem and to thereby provide a manufacturing method of a field emission cathode, which method exerts no adverse effect on the element characteristics when the etching is performed by using an ion beam.

It is conceivable to use a resin, such as a resist, for the sacrificial layer in place of the sacrificial layer made of Al so as to prevent the element characteristics of the field emission cathode from being adversely affected by the ion beam. However, the sacrificial layer made of the resin has a problem that, when the ion beam is irradiated at the time of the etching, a depression (sagging) is caused around the gate hole and the hole of the insulating layer. When the depression is caused, depositions are formed on the wall surface of the gate hole and may cause an insulation failure between the substrate and the gate electrode.

Thus, in order to achieve the above described object, the present invention provides a manufacturing method of a field emission cathode, the manufacturing method comprising: a step of forming, on a substrate in this order, an insulating layer, a gate electrode layer, and a sacrificial layer made of a thermosetting resin which exhibits Vickers hardness in the range of Hv 95 to 140 by heating; a step of curing the sacrificial layer by maintaining the sacrificial layer at a temperature in the range of 180 to 210° C. for a predetermined time; a step of forming an opening section in the sacrificial layer and the gate electrode layer by irradiating a focused ion beam; a step of forming a hole section by etching the insulating layer by using the sacrificial layer and the gate electrode layer as a mask; a step of forming an emitter electrode on the substrate in the hole section by vapor-depositing an emitter material from vertically above the substrate; and a step of removing the emitter material together with the sacrificial layer on the gate electrode layer.

In the manufacturing method according to the present invention, the insulating layer, the gate electrode layer, and the sacrificial layer are first formed on the substrate in this order. The sacrificial layer is made of a resin which exhibits Vickers hardness in the range of Hv 95 to 140 by heating.

Next, the sacrificial layer is cured by being maintained at a temperature in the range of 180 to 210° C. for a predetermined time, for example, 1 to 15 minutes. At a temperature below 180° C., the sacrificial layer does not exhibit Vickers hardness of Hv 95 or more. Further, at a temperature above 210° C., the sacrificial layer exhibits Vickers hardness exceeding Hv 140.

Next, the opening section is formed in the sacrificial layer and the gate electrode layer by irradiating with the focused ion beam. At this time, the sacrificial layer has Vickers hardness in the above described range, and hence no depression (sagging) is formed around the opening section.

When the sacrificial layer has Vickers hardness of less than Hv 95, a depression (sagging) is formed around the opening section by irradiation of the focused ion beam. Further, when the sacrificial layer has Vickers hardness exceeding Hv 140, a crack is formed in the sacrificial layer at the time of curing, and the sacrificial layer is separated at the time of etching the insulating layer in the subsequent process. When the sacrificial layer is separated, it is not possible to continue the subsequent manufacturing steps.

Next, the hole section is formed by etching the insulating layer by using the sacrificial layer and the gate electrode layer as a mask.

Further, the emitter electrode is formed on the substrate in the hole section by vapor-depositing the emitter material from vertically above the substrate. Then, the field emission cathode can be obtained by removing the emitter material on the sacrificial layer together with the sacrificial layer on the gate electrode layer.

According to the manufacturing method of the present invention, the depression of the sacrificial layer, which depression is formed around the opening section by the irradiation of the focused ion beam, can be reduced to within a permissible range. Thus, the insulation failure between the substrate and the gate electrode can be prevented, and the value of the electron emission field can be lowered.

DETAILED DESCRIPTION OF THE PREFERRED EMBODIMENTS

Next, an embodiment of the present invention will be described in more detail with reference to the accompanying drawings.

Figure 1:
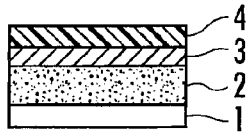
FIG. 1 is an explanatory sectional view showing the steps of a manufacturing method of a field emission cathode according to the present invention.
Figure 1:
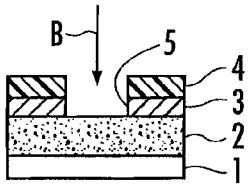
Figure 1:
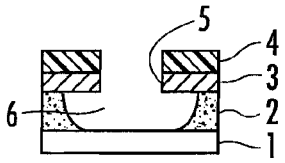
Figure 1:
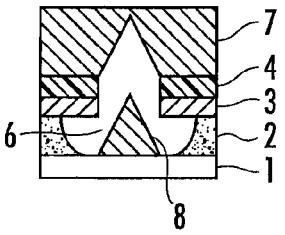
Figure 1:
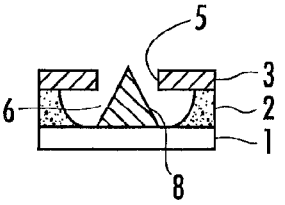
Figure 2:
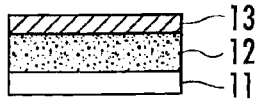
FIG. 2 is an explanatory sectional view showing the steps of an example of a conventional manufacturing method of a field emission cathode.
Figure 2:
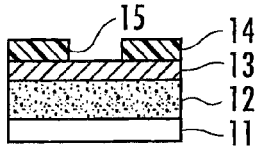
Figure 2:
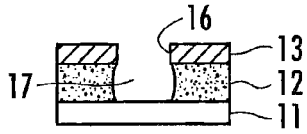
Figure 2:
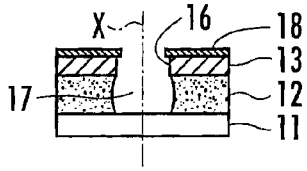
Figure 2:
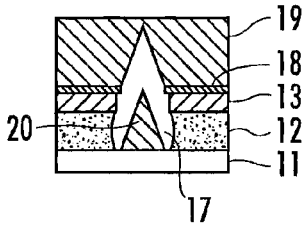
Figure 2:
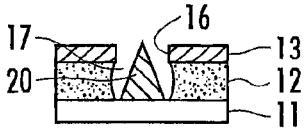
Figure 3:
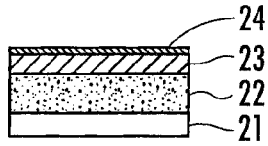
FIG. 3 is an explanatory sectional view showing the steps of another example of the conventional manufacturing method of the field emission cathode.
Figure 3:
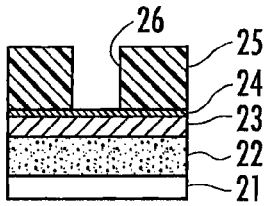
Figure 3:
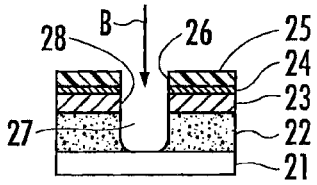
Figure 3:
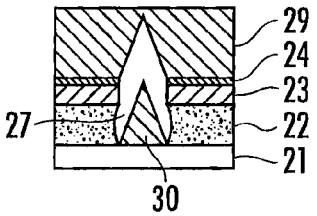
Figure 3:
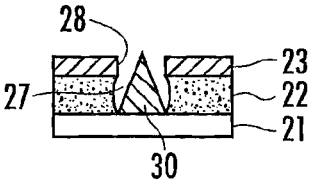

In a manufacturing method of a field emission cathode, according to a present embodiment, an insulating layer 2, a gate electrode layer 3, and a sacrificial layer 4 are first formed in this order on an n-Si substrate 1 as shown in FIG. 1(*a*). The insulating layer 2 is made of $SiO_2$ and is formed, for example, in a thickness of 700 nm by a CVD method. The gate electrode layer 3 is made of, for example, Ni and is formed, for example, in a thickness of 200 nm by a sputtering film forming method.

The sacrificial layer 4 is usually made of a thermosetting resin (made by Nippon Zeon Co, Ltd, product name: ZEP520A) used as an electron beam resist. As the sacrificial layer 4, a coating film having a thickness of 400 nm is formed in such a manner that the thermosetting resin is applied on the gate electrode layer 3 by spin coating and is thereafter heated and cured.

The spin coating of the thermosetting resin is performed, for example, at a revolution speed of 2500 rpm for 90 seconds. Further, the thermosetting resin is heat-cured by being maintained at a temperature of 180 to 210° C. for 1 to 15 minutes, for example, 10 minutes. As a result, the sacrificial layer 4 can be formed to have Vickers hardness in the range of Hv 95 to 140.

When the sacrificial layer 4 is formed, then, as shown in FIG. 1(*b*), the sacrificial layer 4 and the gate electrode layer 3 are etched by irradiating a focused ion beam B, so that an opening section 5 is formed. The focused ion beam B has, for example, a beam diameter of 20 nm at an extraction voltage of 30 kV, and forms, for example, 10000 opening sections 5 having a diameter of 0.6 μm.

Next, as shown in FIG. 1(*c*), the insulating layer 2 is etched with a fluorine etchant by using, as a mask, the sacrificial layer 4 and the gate electrode layer 3 in which the opening section 5 is formed. Thereby, the surface of the Si substrate 1 is exposed. After the etching is completed, the etchant is removed by washing with water. As a result, a hole section 6 is formed in the insulating layer 2.

Next, an emitter material 7 made of carbon is deposited by irradiating a carbon ion beam from vertically above the substrate 1, so that a cone-shaped emitter electrode 8 is formed on the substrate 1 in the hole section 6. The carbon ion beam can be irradiated with, for example, deposition energy of 150 V, and can form the emitter electrode 8 made of diamond-like carbon (DLC).

Next, as shown in FIG. 1(*e*), a field emission cathode can be obtained in such a manner that the emitter material 7 is removed together with the sacrificial layer 4 on the gate electrode layer 3 by using an organic solvent (made by Tokyo Ohka Kogyo CO, LTD, product name: stripping liquid 502A) composed mainly of aromatic hydrocarbon. As shown in FIG. 1(*e*), the field emission cathode obtained by the above described manufacturing method comprises the Si substrate 1, the insulating layer 2 provided on the Si substrate 1, the emitter electrode 8 provided on the Si substrate 1 in the hole section 6 provided in the insulating layer 2, and the gate electrode layer 3 provided on the insulating layer 2. Further, the gate electrode layer 3 comprises the opening section 5 as the gate hole.

Next, the sacrificial layers 4, each having different Vickers hardness, were formed by changing the heating temperature of the thermosetting resin at the time of forming the sacrificial layers 4. Then, the states of the sacrificial layer 4, the formation rates of depositions (caps) on the wall surface of the opening section 3, and the electron emission fields were respectively compared with each other. The comparison result is shown in Table 1. The formation rate of depositions was calculated by the following expression after the number of the opening sections 3 with depositions on the wall surface thereof among the 6400 opening sections 3 was obtained by observing, with a scanning electron microscope, the field emission cathode obtained by the manufacturing method of the present embodiment.

Formation rate of depositions (%)=(the number of opening sections 3 with depositions on wall surface thereof/6400)×100

TABLE 1

| | Heating temperature (° C.) | Heating time (min.) | Vickers hardness (Hv) | State of sacrificial layer 4 | Formation rate of depositions (%) | Electron emission field (V) |
|---|---|---|---|---|---|---|
| Comparison example 1 | 155 | 10 | 85.6 | xN | 55 | Measurement impossible |
| Comparison example 2 | 160 | 10 | 90.1 | xN | 38 | Measurement impossible |
| Example 1 | 180 | 10 | 95.3 | ○Y | 19 | 24 |
| Example 2 | 190 | 10 | 98.3 | ○Y | 3 | 24 |
| Example 3 | 200 | 10 | 120.4 | ○Y | 1 | 17 |
| Example 4 | 210 | 10 | 140.0 | ○Y | 3 | 16 |
| Comparison example 3 | 220 | 10 | 148.6 | Separated at the time of washing with water | — | — |

State of sacrificial layer 4
○Y Depression (sagging) within permissible range
xN Depression exceeding permissible range From Table 1, it is obvious that in the examples 1 to 4 in which the thermosetting resin was cured by being maintained at a temperature of 180 to 210° C. for 10 minutes, the Vickers hardness of the sacrificial layer 4 is in the range of Hv 95.3 to 140, and thereby the depression formed around the opening section 5 can be reduced to within a permissible range. As a result, it is obvious that in the examples 1 to 4, the formation of depositions on the wall surface of the opening section 5 can be reduced to the range of 1 to 19%, and the electron emission field can be reduced to a low value of 16 to 24 V.

Contrary to the examples 1 to 4, from the comparison examples 1 and 2 in which the thermosetting resin was cured by being maintained at a temperature of 155 to 160° C. for 10 minutes, it is obvious that the Vickers hardness of the sacrificial layer 4 is less than 95 and thereby the depression cannot be reduced to within the permissible range. As a result, in the comparison examples 1 and 2, the formation of the depositions on the wall surface of the opening section 5 was increased to 33 to 58%, and thereby an insulation failure was caused between the substrate 1 and the gate electrode layer 3, so as to make it impossible to measure the electron emission field.

Further, in the comparison example 3 in which the thermosetting resin was cured by being maintained at the temperature of 220° C. for 10 minutes, the Vickers hardness of the sacrificial layer 4 exceeded Hv 140, and a crack was formed in the sacrificial layer 4. As a result, in the comparison example 3, the sacrificial layer 4 was separated during the washing with water after the etching of the insulating layer 2. Thereby, the subsequent processes could not be continued, and the field emission cathode could not be manufactured.

Note that in the present embodiment, the sacrificial layer 4 is formed of the thermosetting resin so that the Vickers hardness of the sacrificial layer 4 is in the range of Hv 95 to 140. However, the sacrificial layer 4 may be made of a material which can reduce, to within the permissible range, the depression formed around the opening section 5 due to the irradiation of the focused ion beam B, and which is not eroded by the etchant used for the etching of the insulating layer 2. For example, the sacrificial layer 4 may be made of a metal material, such as Ni and Cr.

What is claimed is:

1. A manufacturing method of a field emission cathode, comprising:

forming, on a substrate in this order, an insulating layer, a gate electrode layer, and a sacrificial layer made of a thermosetting resin which exhibits Vickers hardness in the range of Hv 95 to 140 by heating;

curing the sacrificial layer by maintaining the sacrificial layer at a temperature in the range of 180 to 210° C. for a predetermined time;

forming an opening section in the sacrificial layer and the gate electrode layer by irradiating with a focused ion beam;

forming a hole section by etching the insulating layer by using the sacrificial layer and the gate electrode layer as a mask;

forming an emitter electrode on the substrate in the hole section by vapor-depositing an emitter material from vertically above the substrate; and removing the emitter material together with the sacrificial layer on the gate electrode layer.

2. The manufacturing method of the field emission cathode according to claim 1, wherein the substrate is made of n-Si.

3. The manufacturing method of the field emission cathode according to claim 1, wherein the insulating layer is made of $SiO_2$.

4. The manufacturing method of the field emission cathode according to claim 1, wherein the gate electrode layer is made of Ni.

5. The manufacturing method of the field emission cathode according to claim 1, wherein the sacrificial layer is made of thermosetting resin comprising an electron beam resist.

6. The manufacturing method of the field emission cathode according to claim 5, wherein the sacrificial layer is cured by being maintained at a temperature in the range of 180 to 210° C. for 1 to 15 minutes.

7. The manufacturing method of the field emission cathode according to claim 1, wherein the sacrificial layer is made of one of Ni and Cr.

8. The manufacturing method of the field emission cathode according to claim 1, wherein the emitter material is carbon and the emitter electrode is made of diamond-like carbon (DLC).

9. The manufacturing method of the field emission cathode according to claim 1, wherein the deposition formation rate represented by percentage of the number of the opening sections with depositions on the wall surface thereof with respect to the total number of the formed opening sections is in the range of 1 to 19%.

* * * * *